US005758573A

United States Patent [19]

Keeler et al.

[11] Patent Number: 5,758,573

[45] Date of Patent: Jun. 2, 1998

[54] PAPERBOARD CARTON PIERCING, CRUSHING AND RECYCLING SYSTEM

[75] Inventors: Donald E. Keeler, Sussex, N.J.; Michael Sinocchi, Suffern; Richard J. Connor, Bloominburg, both of N.Y.; Fred Karsa, Wantage, N.J.; Wilfred A. Côté, Goshen, N.Y.

[73] Assignee: International Paper Company, Purchase, N.Y.

[21] Appl. No.: 663,396

[22] Filed: Jun. 13, 1996

[51] Int. Cl.[6] ..... B30B 15/14; B30B 9/20; B30B 3/04

[52] U.S. Cl. ..... 100/49; 100/53; 100/98 R; 100/131; 100/172; 100/174; 100/176; 241/37.5; 241/99

[58] Field of Search ..... 100/49, 53, 98 R, 100/131, 172, 174, 176, 902; 241/36, 37.5, 99, 100, 606

[56] References Cited

U.S. PATENT DOCUMENTS

| | | | |
|---|---|---|---|
| 1,181,660 | 5/1916 | Gensheimer | 100/174 |
| 1,598,364 | 8/1926 | Cassell et al. | 100/98 R |
| 2,808,776 | 10/1957 | Palmer | 100/98 R |
| 3,183,825 | 5/1965 | James | 100/98 R |
| 3,389,864 | 6/1968 | Topinka | 241/606 |
| 3,489,354 | 1/1970 | Harper et al. | 100/176 |
| 3,749,004 | 7/1973 | Pagdin | 100/176 |
| 4,345,679 | 8/1982 | DeWoolfson | 100/902 |
| 4,669,673 | 6/1987 | Lodovico et al. | 241/99 |
| 4,925,117 | 5/1990 | Ramos | 241/236 |
| 4,953,682 | 9/1990 | Helbawi | 100/902 |
| 4,987,829 | 1/1991 | Hudson et al. | 100/98 R |
| 5,025,994 | 6/1991 | Maitlen et al. | 241/99 |
| 5,042,634 | 8/1991 | Gulmini | 100/902 |
| 5,152,387 | 10/1992 | Hammond | 100/176 |
| 5,211,109 | 5/1993 | Determan | 100/98 R |

FOREIGN PATENT DOCUMENTS

| | | | |
|---|---|---|---|
| 3504248 | 8/1986 | Germany | 100/902 |
| 93/13861 | 7/1993 | WIPO | 241/606 |

*Primary Examiner*—Stephen F. Gerrity
*Attorney, Agent, or Firm*—Michael J. Doyle

[57] ABSTRACT

A paperboard carton piercing-crushing and recycle system and apparatus which includes a safety operated door which controls motor operated carton piercing and crushing rolls in order to crush paperboard cartons for disposal. The safety operated door is provided with a magnetic switch which controls two different timed electrical circuits. One circuit controls an electronic safety latch mechanism which prevents the carton disposal door from opening during operation of motor driven carton crushing rolls and one timed circuit operates the motor during the time that the electronic safety latch mechanism prevents the door from operating. When the motor circuit stops, the timer to the electronic safety latch mechanism releases the safety latch so that the door can be opened. Thus, the system is safe and will not operate if the carton disposal door is open.

18 Claims, 9 Drawing Sheets

FIG. 9
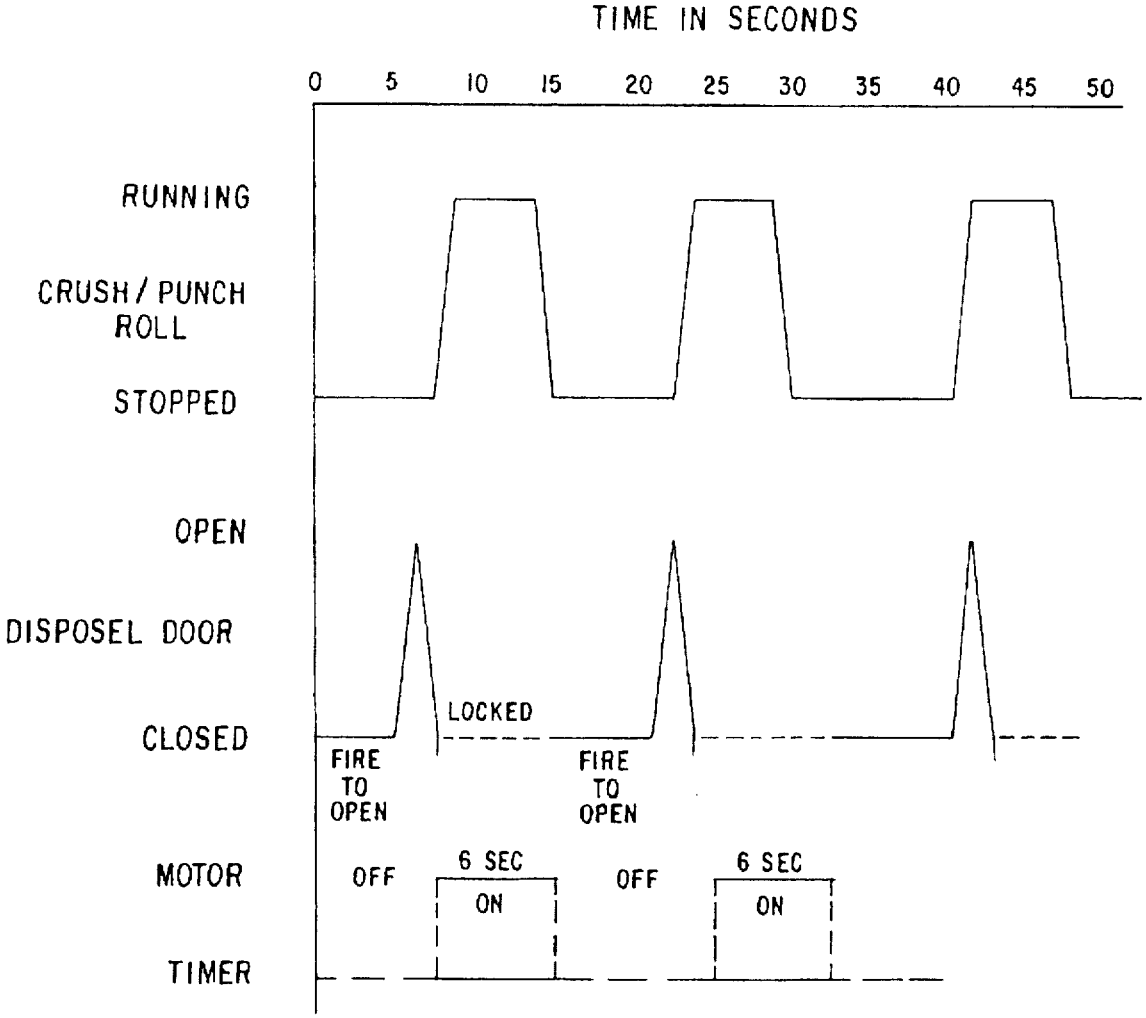
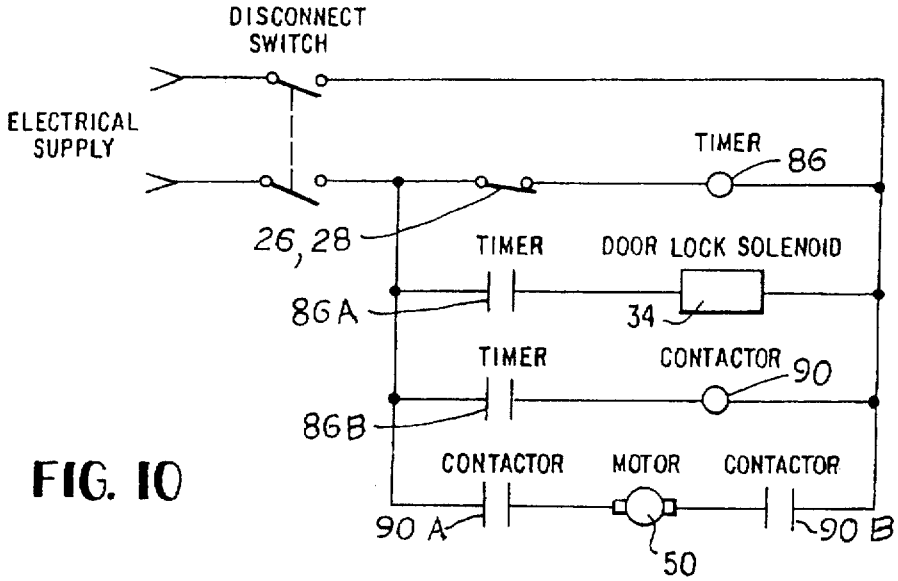
FIG. 10

PAPERBOARD CARTON PIERCING, CRUSHING AND RECYCLING SYSTEM

BACKGROUND OF THE INVENTION

This invention relates to a crushing and recycling system and more particularly to a paperboard carton crushing and recycling system.

Heretofore, crushing and recycling systems or devices have been made for piercing and crushing steel, aluminum and plastic containers. Such known devices crush soda pop cans, beer cans, and some have been used to pierce oil cans which reclaim the oil left in the can as well as crush the can. These devices are usually of heavy duty construction and of complex design which require precision tooling and synchronized gearing in order for the systems to operate effectively. As such, these prior art systems are usually very expensive to manufacture, maintain and sometimes difficult to service. Also, these devices are usually bulky and require a lot of room to set up and operate.

SUMMARY OF THE INVENTION

This invention is directed to a paperboard carton piercing and crushing system which is simple in structure, requires very little maintenance, and is small enough to be used by schools, colleges, amusement parks, and fast food restaurants for processing paperboard cartons after the contents have been used. The processed cartons are then taken to land fills.

The device is provided with an interlock system which permits a door for disposal of the cartons to be opened only when the crusher rollers are not operating. The door, when open, permits entry of a carton for disposal, and when closed, a timed switching arrangement operates a plunger which prevents the door from opening and then starts a motor for operation of the two piercing-crushing rollers. The carton slides down a chute to be engaged by side-by-side rollers, the latter provided with piercing pins that pierce the carton to release any residual liquid that may remain in the carton. Then the carton is crushed as the carton is pulled between the rollers by the piercing pins. The crushed cartons are dropped into a receptacle or bag which may be provided with holes in the bottom so that any residual liquid can pass through the receptacle and be captured in a container for disposal. For permanently installed systems the liquid may be drained into a disposal system.

According to the practice of the invention a carton piercing and crushing system is provided which is affordable by small institutions such as schools and small restaurants.

Further, a carton piercing and crushing system is provided which does not require a great deal of precision during manufacture and requires very little if any maintenance. Another important feature is the provision of a carton piercing and crushing system which is safe to use by children and which will prevent injury by the piercing and crushing rollers. The carton piercing and crushing system of this invention can be operated with a usual 110 volt electrical system.

BRIEF DESCRIPTION OF THE DRAWINGS

FIG. 9 is a schematic view showing the time relationship of operation of the crushing rolls, the disposal door, and the motor.

FIG. 10 is a schematic view of an electrical circuit which controls the operation of the device.

DETAILED DESCRIPTION OF THE INVENTION

Figure 1A:
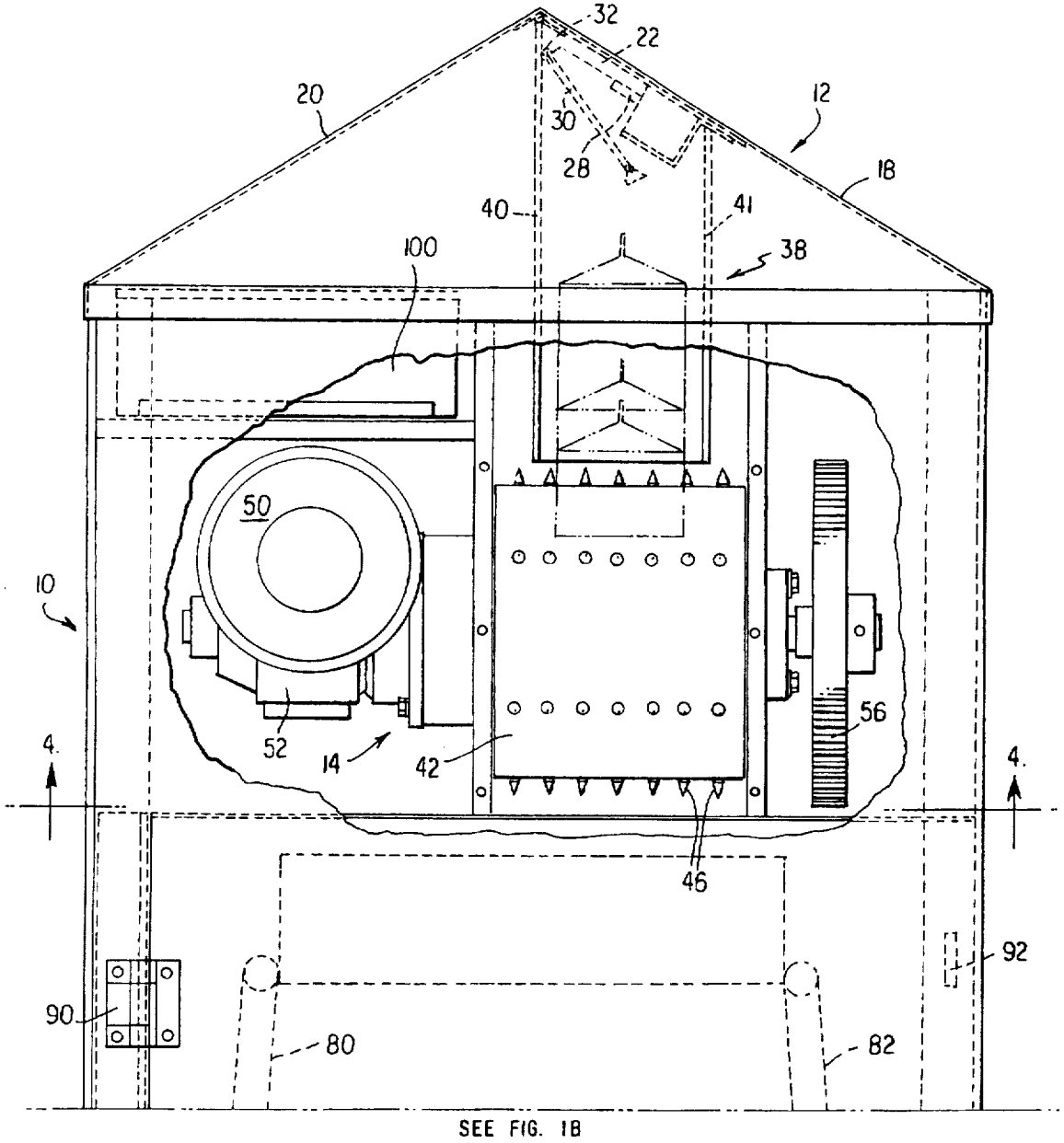
FIGS. 1A and 1B, taken together, define a side elevational view of the present device and system, with a part of an upper wall broken away.
Figure 1B:
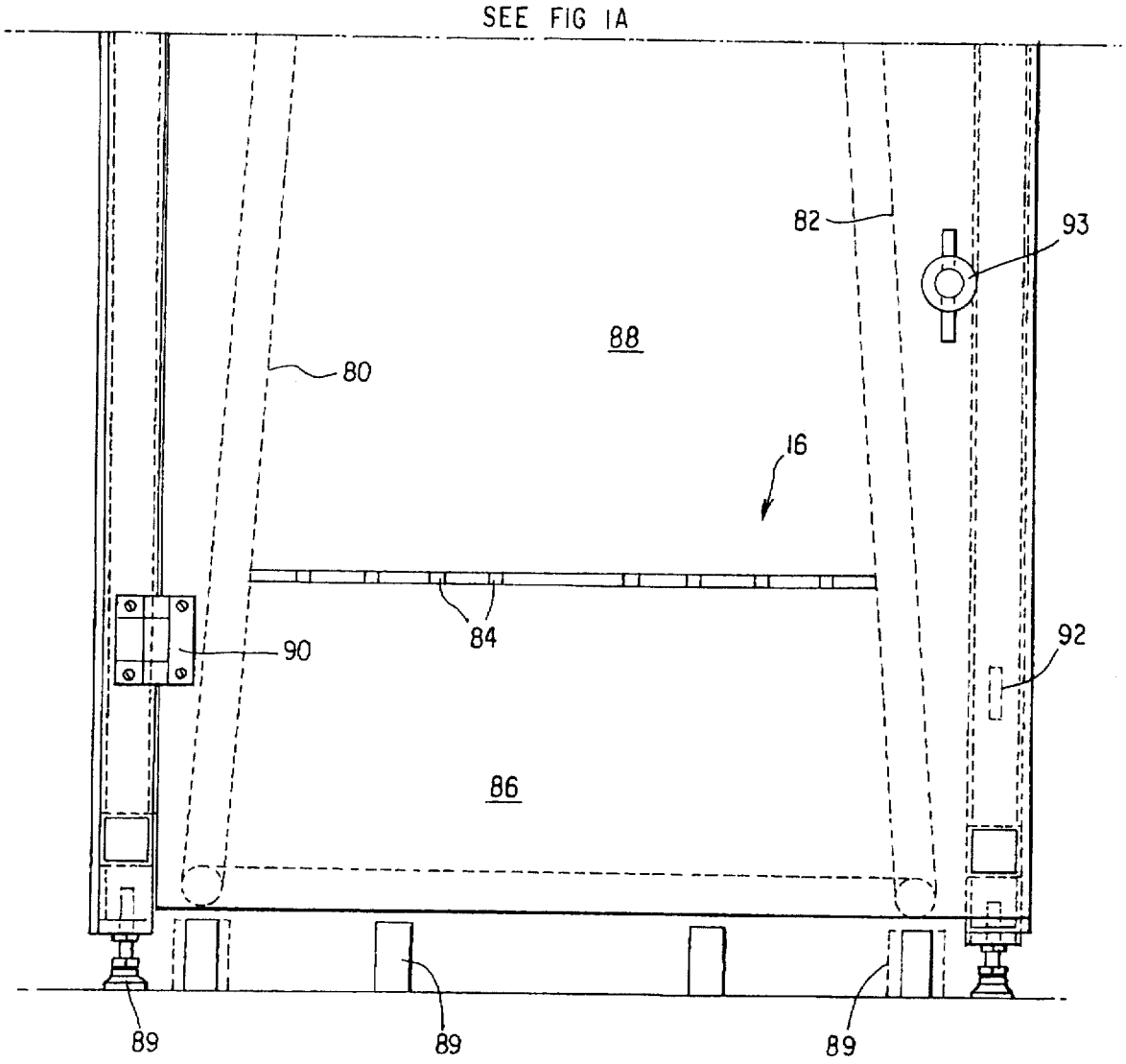
Figure 2:
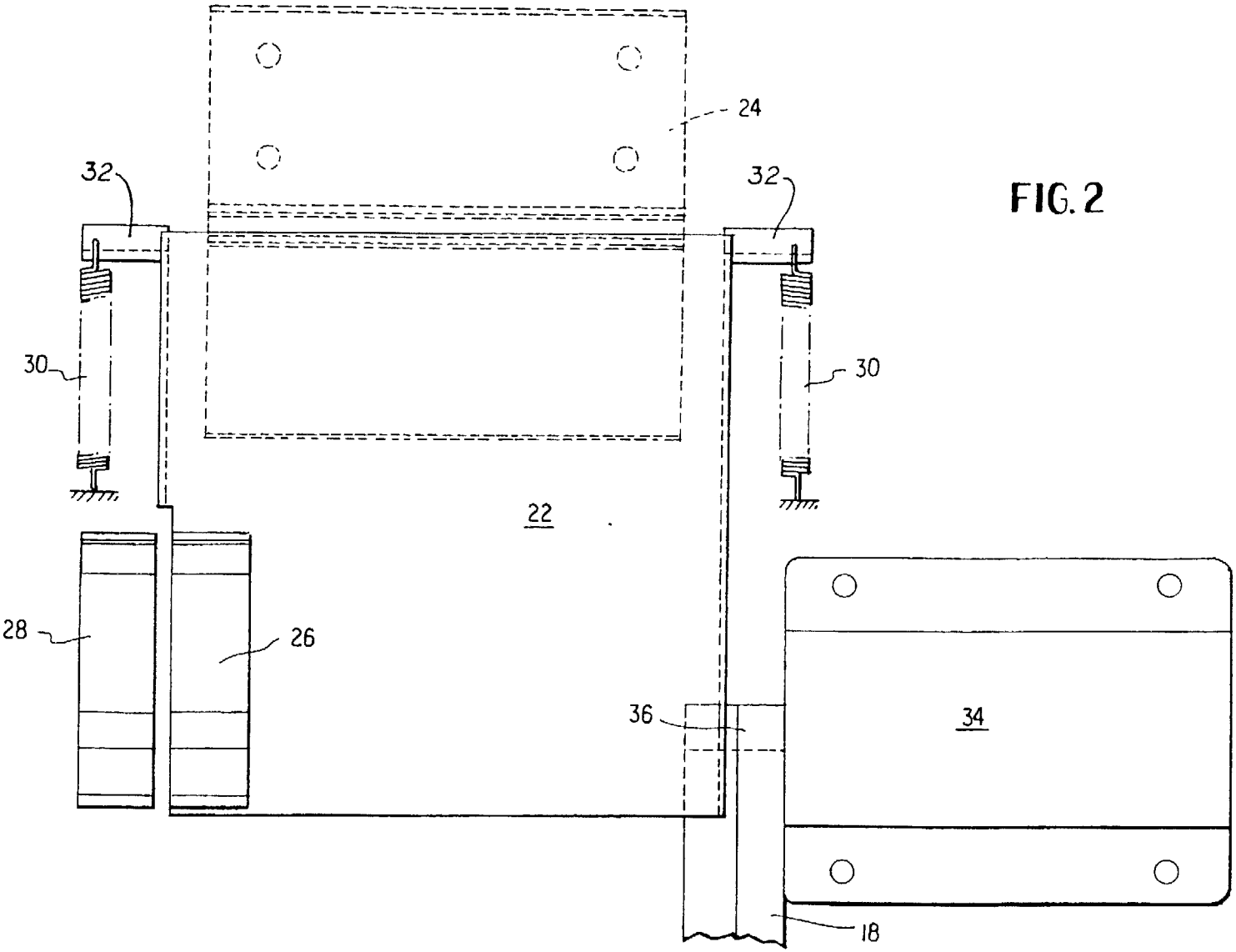
FIG. 2 is a plan view of one top wall which illustrates a door through which empty cartons are inserted.
Figure 3A:
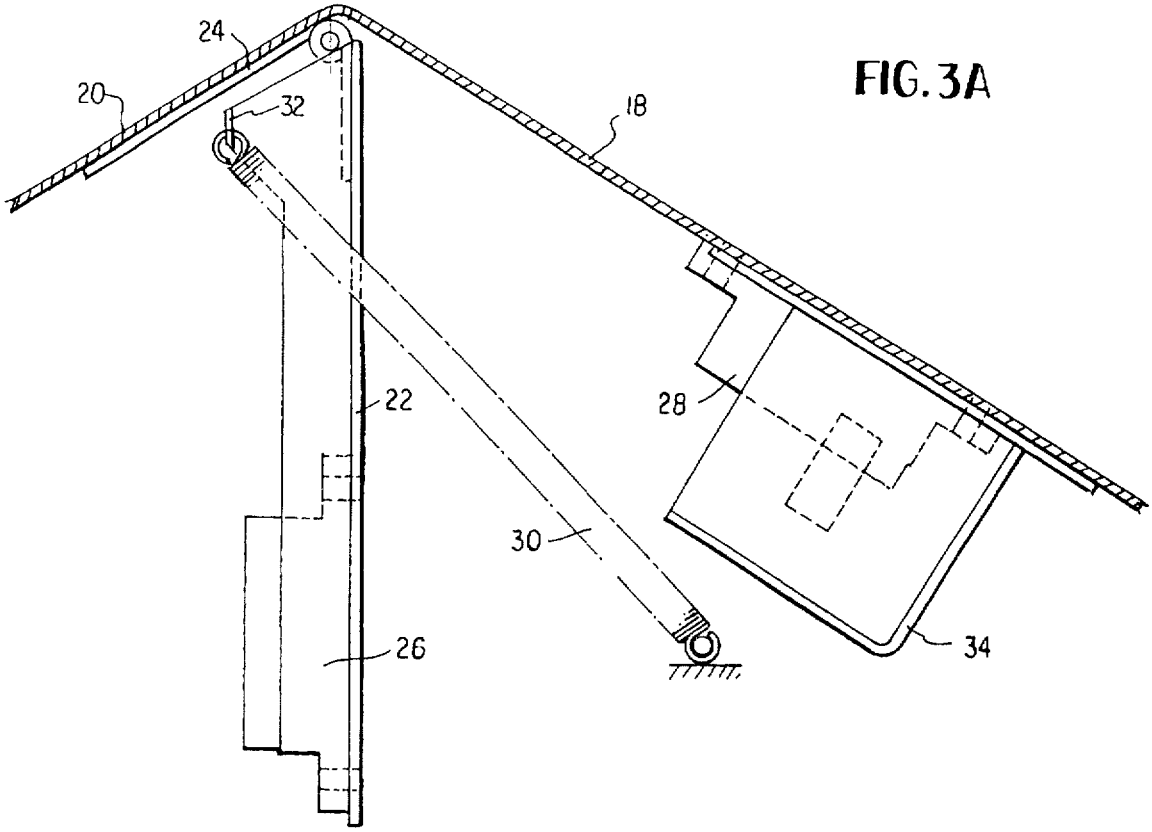
FIGS. 3A and 3B are partial side elevational views and illustrate the door shown in FIG. 2 in respective open and closed positions.
Figure 3B:
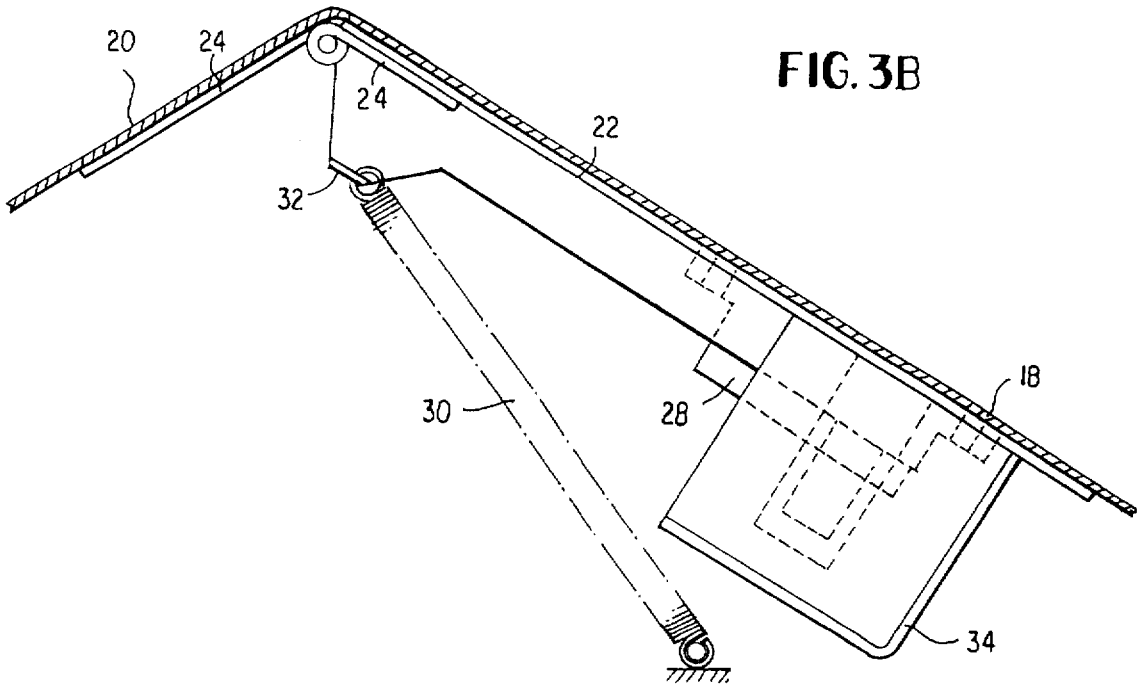

Now referring to the drawings, FIGS. 1A and 1B, taken together, define a side elevational view of the present device and system which includes a housing 10, an upper end carton deposit section 12, a middle piercing and crushing section 14, and a crushed carton and liquid collection section 16. The upper end carton deposit section includes opposite sloping upper end walls 18, 20 which are closed in by opposite side walls. Sloping end wall 18 is provided with a rectangular door 22 which is hinged at its upper end by a butt hinge 24 by which one half of the hinge is secured to the under surface of sloping end wall 20 and the other half of the hinge is secured to the under surface of door 22, as further seen in FIGS. 3*a* and 3*b*. The door is provided with one portion 26 of a magnetic switch, the switch including another, stationary portion 28 secured to end wall 18 juxtaposed with the movable portion 26. The magnetic switch is a two element proximity switch such as Model 115 marketed by Sentral Ind. and will be further explained later in the description. One element 26 thereof moves with door 22 while portion or element 28 thereof is stationary. Door 22 is provided with a spring 30 opposite each side thereof. Each spring has an upper end secured to a protrusion 32 of the door and a lower end secured to end wall 18. The side of the door opposite from magnetic switch 26 is provided with a solenoid operated electronic safety latch mechanism 34 which is provided with a plunger 36, see FIG. 2. A suitable safety latch mechanism is a Hoffman model A-EK115NDH which is electrically operated. The operation of the door, magnetic switch and the safety latch mechanism will be explained later in greater detail. Extending downwardly from the door opening is a chute 38 which has a back wall 40 that extends to the peak of the upper section which restricts further movement of the door to the door open position and a front wall 41 which is secured to the under surface of the upper wall 18 just in front of the end of the door 22. Thus, the door 22 opens to expose the upper end of chute 38. The chute has end walls, not shown, to thus form an enclosed chute.

Figure 4:
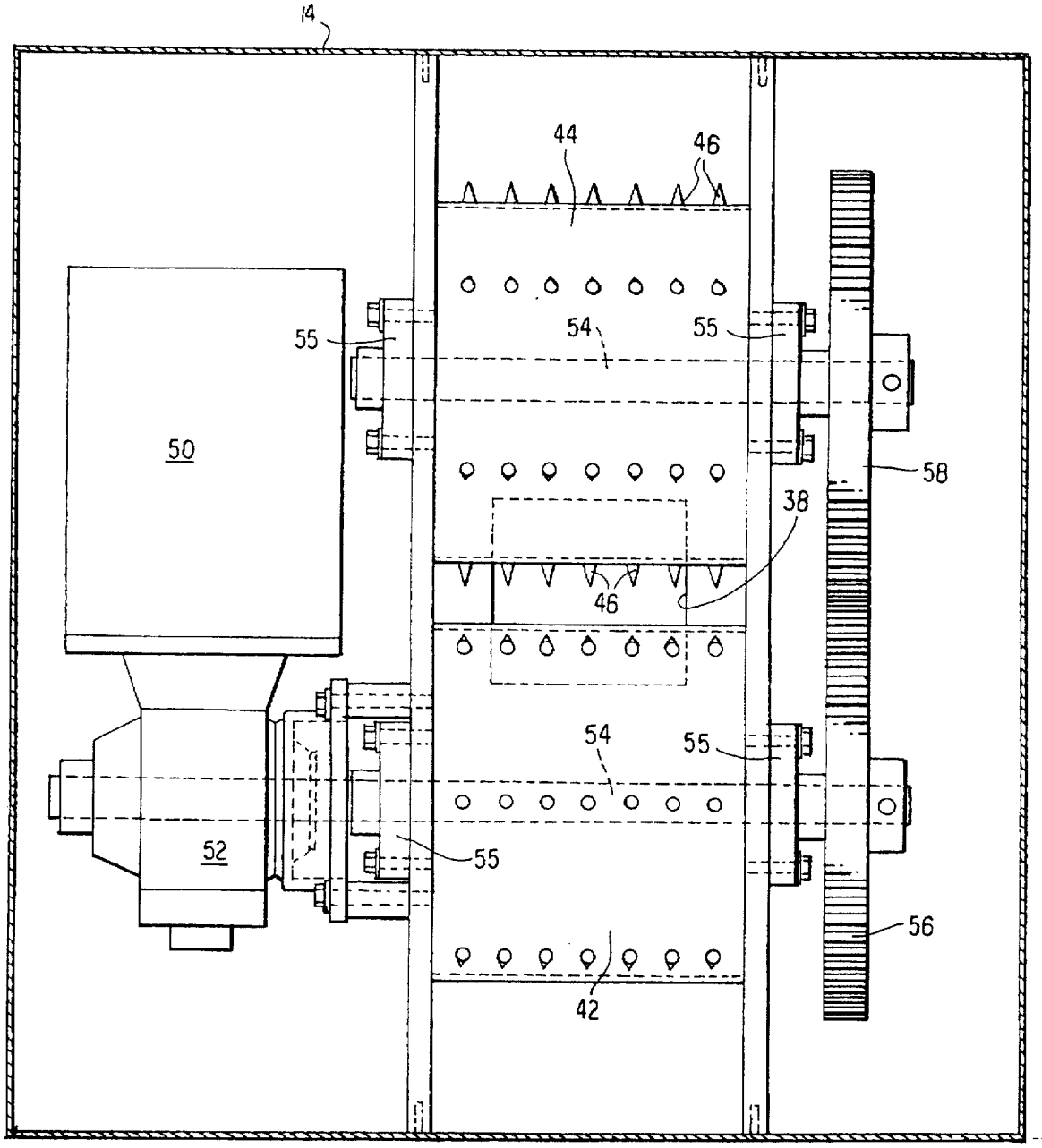
FIG. 4 is a view along line 4—4 of FIG. 1A looking from below and up into crushing section 14.
Figure 5:
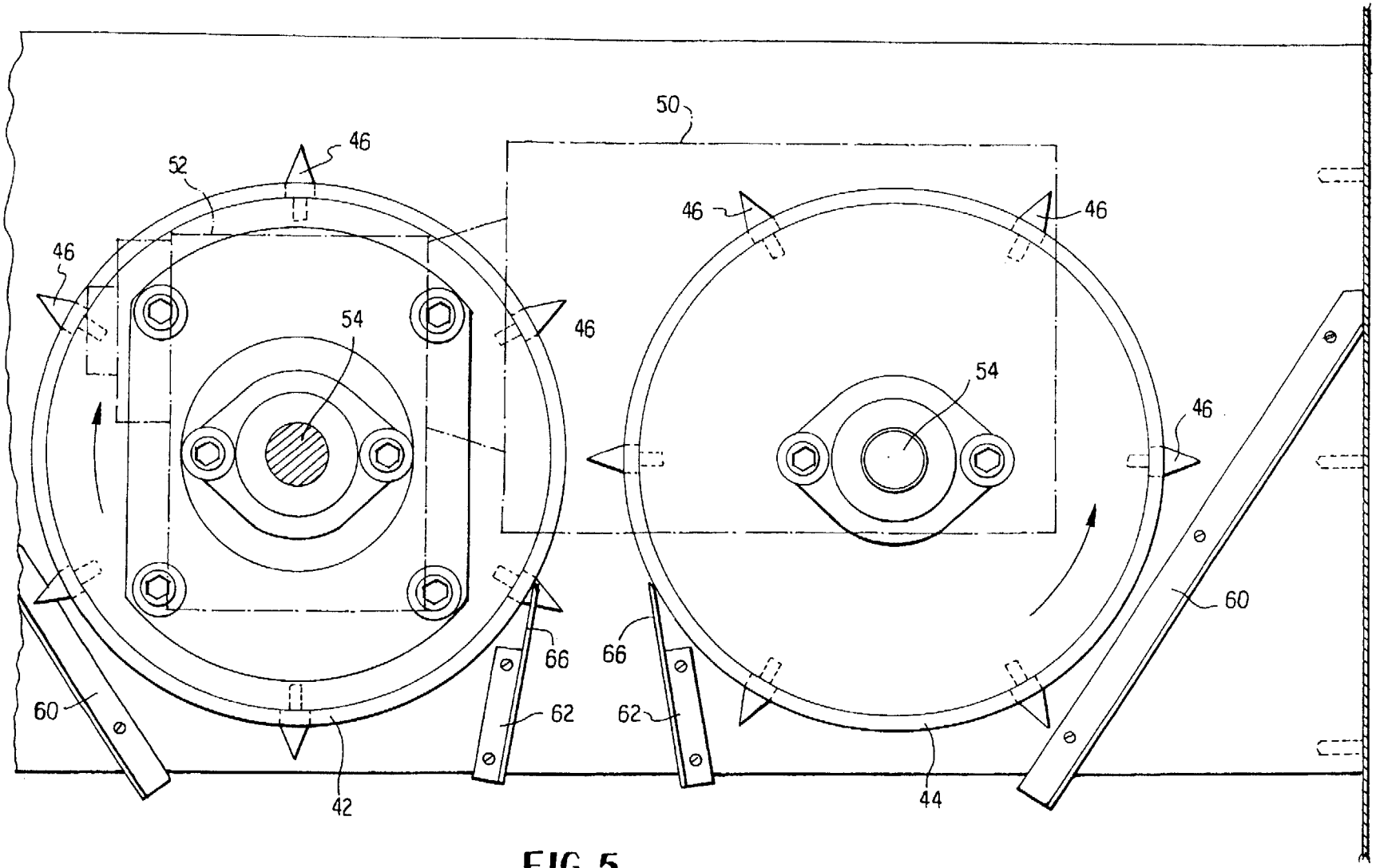
FIG. 5 illustrates an end view of the crushing rollers illustrates certain crushed carton stripper plates.
Figure 7:
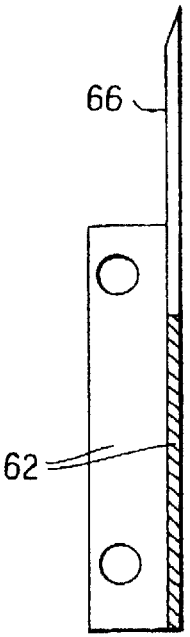
FIG. 7 is a sectional view taken along section 7—7 of FIG. 6.
Figure 6:
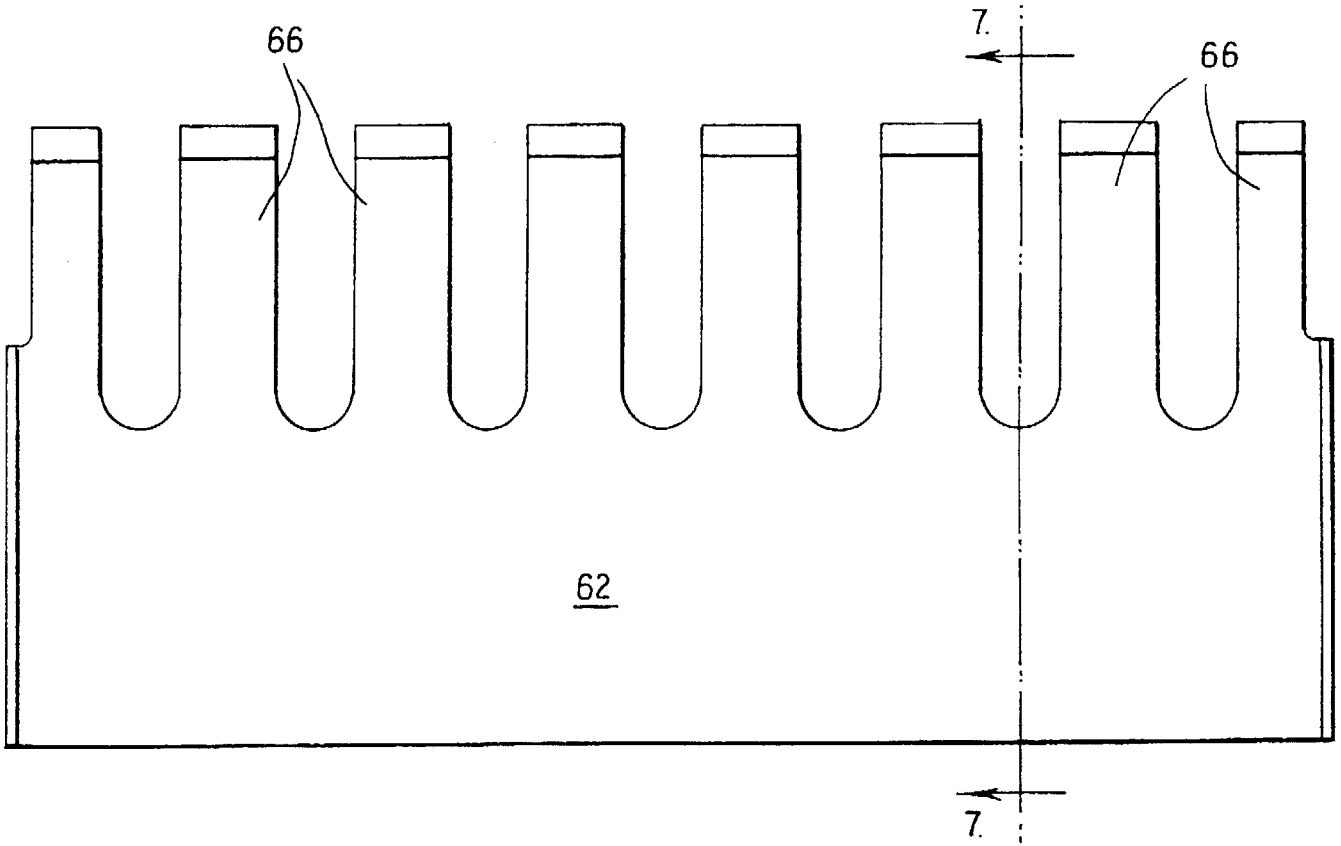
FIG. 6 illustrates a stripper plate for stripping pierced and crushed cartons from the rolls.

The lower end of the chute is located just above a pair of crushing and piercing rolls 42, 44 in the mid-section 14. As shown in FIG. 1, only one roll 42 is seen. FIG. 4 is a view which illustrates the rolls. Each of the rolls (rollers) is provided with circumferentially spaced piercing pins 46 which protrude from respective circumferential surface portions at 60 degree intervals. The rolls are driven by an electric motor 50 through a reduction gearing assembly 52. The rolls are each rotatable on an axle 54 which is rotatable in fixed bearings 55. The roll 42 is driven by the reduction gearing and the roll 44 is driven by suitable spur gears 56, 58 which are in turn driven by the roll 42. The housing 10 is provided with a frame and support braces where necessary and, in order to strip the pierced and crushed cartons from the rolls, an inner stripper plate 62 is provided for each roll, see FIG. 5. Each stripper plate is secured at one end thereof to a part of the frame and each other end includes fingers 66 which extend tangentially up toward the rolls and between the piercing pins 46. A typical inner stripper plate 62 is shown in FIGS. 6 and 7. FIG. 6 is a top view of an inner stripper plate 62 and FIG. 7 a view taken along section 7—7 of FIG. 6. It is seen that each plate 62 has slots between fingers 66, the slots receiving pins 46 to thus permit the tips of fingers 66 to assist in scraping the crushed cartons off of the roll surfaces. Additional and outer unslotted stripper plates 60 may also be provided to assist in removing crushed cartons or carton pieces form the rolls and pins thereon. FIG. 5 shows a clearance between the tips of pins 46 and plates 60 during rotation of the rolls.

Figure 8:
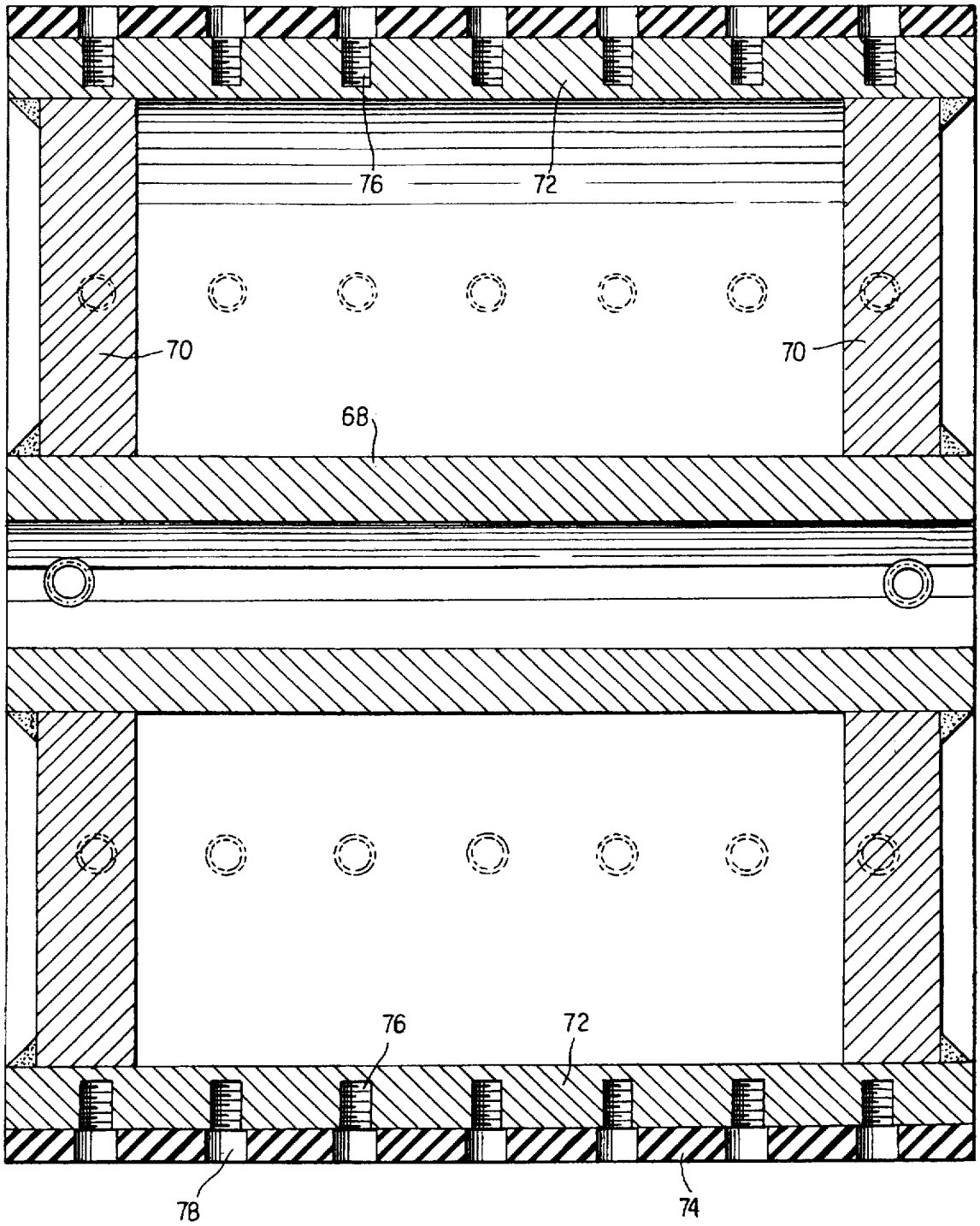
FIG. 8 is a cross-sectional view of a crushing roll without piercing pins.

FIG. 8 is a longitudinal sectional view of either one of the rolls 42, 44. As shown, each roll is formed by an inner cylindrical tube 68 to which round end plates 70 are secured as by welding. An outer cylindrical metal tube 72 is secured to the outer periphery of the end plates 70 to form a closed roll with outer cylindrical tube 72 coaxial with an inner cylindrical tube 68. The outer surface of cylindrical tube 72 is covered with an equal thickness of a plastic or elastomer material such as NEOPRENE 74. As shown, the aluminum tube 72 and the covering 74 are provided with holes 76, 78 respectively, in which the piercing pins 46 are secured. Holes 76 are threaded. The rolls may be made of aluminum, stainless steel, or any other suitable hard material that will not easily corrode.

The bottom portion of the device receives the pierced and crushed cartons in a suitable receptacle 80 (see FIG. 1B) such as a plastic bag held in place by a retainer 82 (see FIG. 1B) or a self standing receptacle 80 which can be changed when it is full of crushed cartons. Since the cartons may still have some waste fluid when deposited through door 22, receptacle 80 is provided with drain holes 84 in the bottom so that the waste fluid can drain into a suitable receptacle 86 for disposal. Thus, there are two separate compartments in the bottom portion of the housing, one for the pierced-crushed cartons, and one for the waste fluid to be disposed. In the event the piercing and crushing device is installed permanently in one position, a drain may be connected to the bottom of the housing and the waste fluid could drain from the piercing-crusher device directly into a sewer drain. The lower portion of the housing is provided with a door 88 supported by hinges 90 and closed by any suitable latch 92 which can be closed, and opened by handle 93 when the pierced-crushed cartons are to be removed. The housing may be supported on adjustable legs or casters 89.

The device is provided with an electrical panel (not illustrated) which includes a timer and motor control (see FIG. 10) which control two different electrical circuits, one for the safety latch mechanism 34 and one for motor 50. The timer is activated by a magnetic field provided by a magnet on carton deposit door 22 when the door 22 is closed, such as magnet portion 26 of the proximity switch 26, 28. One set of timer switches controls the electronic safety latch mechanism 34 to prevent the door 22 from being opened while the motor operated rolls 42, 44 are rotating and a second timer switch or contact pair controls the starting and stopping of motor 50 for rotating the rolls. The motor (and rolls) cannot be operated while door 22 is open during deposit of a carton to be crushed. During the time that the door is closed and the motor is operating, the electronic safety latch mechanism 34 is actuated so that the door cannot be opened.

In operation of the device, typically at 120 volts, the disposal receptacle and waste fluid catch or drain are provided in the bottom portion of the housing. The carton reception door 22 is biased closed by springs 30. When a person deposits a carton to be expended, the door 22 is pushed open against the force of the springs 30. The carton is then deposited into chute 38 and the carton falls to the nip of piercing and crushing rolls 42, 44. Upon withdrawal of the person's hand, the door is then closed automatically by the force of springs 30. With such door closure, the magnetic switch 26, 28 causes two timer switches to close. The first timer switch causes the electronic safety latch mechanism 34 to operate, which forces the plunger 36 (FIG. 2) to a position below the door 22 and prevents the door from being opened, and after the safety plunger 36 has been operated, the second timer causes the motor 50 to operate which rotates the rolls 42, 44 through reduction gearing 52. The carton falls downwardly between rolls 42, 44, with piercing pins 46 puncturing the carton to release any waste fluid therein and also pull the carton down and through the nip of the rolls. The carton is stripped from the rolls by fingers 66 of strippers 62, so that the crushed carton falls into the receptacle. The waste fluid in the used carton passes through the receptacle into the waste fluid receptacle. After a predetermined time for operation of the motor to crush the carton, the motor stops, rolls 42, 44 stop turning and the electronic safety latch mechanism 34 withdraws the plunger 36 from below the door so the door is now ready to be opened for the deposit of another carton. It is therefore seen that the device is safe for a person of any age to deposit an empty carton because the device will not operate until the door is closed after being opened. The motor will not operate while the door is open.

FIG. 9 schematically illustrates the timing operation of the motor and the opening and closing of door 22. The upper curve denotes the operation of crushing rolls 42, 44. The middle curve denotes the opening and closing of door 22, while the lower curve denotes the operation of motor 50. When the door has been closed for a relatively long period of time, the motor is in a normal or non operating mode. When door 22 is opened and then closed, as indicated by the first spike of the second curve, the closing of the door causes a first timer switch to operate latch control mechanism 34 to actuate plunger or latch 36 to prevent door opening. Upon actuation of plunger 36, a second timer switch starts motor 50 for a predetermined time, such as six seconds (by way of example only), as indicated at the third curve. At the end of this period the motor stops and plunger 36 is withdrawn, thus permitting the next cycle of door opening and closing, door latching, motor operation and door unlatching.

While the door switch 26, 28 has been shown and described as a magnetic proximity switch, it could be a mechanical switch, such a toggle switch whose projecting leg is actuated by opening and closing door 22. Examples of mechanical switches for a similar purpose are shown in U.S. Pat. Nos. 2,882,360 issued to Sisson and 3,716,122 issued to Baker, both incorporated by reference. However, a magnetic proximity switch is preferred due to its longer life and relative freedom from shock injury due to possible contact with the cartons as they are inserted.

Referring now to FIG. 10, the motor and door lock electrical controls are shown. Magnetic switch 26, 28 detects the opening of door 22. Upon closure of door 22, a signal is applied to a timer 86 (not shown in the other drawings). The timer then closes contact pairs 86A and 86B. With these contact pairs closed, both door lock solenoid 34 and motor contactor 90 are energized. Solenoid latch mechanism 34 actuates bolt 36 and thus prevents door 22 from being opened, and motor 50 is running by virtue of its contactors 90A and 90B being closed by contactor 90. When timer 86 has run through its period, contact pairs 86A and 86B open, thus deactivating solenoid 34 to permit reopening of door 22 and actuating contactor 90 to open contactors 90A and 90B to stop the motor. Opening of door 22 to dispose of another carton restarts the cycle just described. It is seen that the circuit of FIG. 10 includes a timed circuit for operating the safety door latch 34 and a timed circuit for operating the motor 50.

We claim:

1. A paperboard carton piercing and crushing device which comprises, a housing, said housing including a carton insertion portion, a piercing and crushing portion, and a crushed carton reception portion, said carton insertion portion including an upper end wall, said carton insertion portion including a door in said upper end wall through which a carton to be pierced and crushed is inserted, an electrical switch, said switch carried by at least one of said door and said upper end wall, said switch controlling an electronic door latch and an electric motor, said electric motor driving a pair of rolls which pierce and crush said carton during operation of said motor, said rolls located beneath said carton insertion portion, said electronic door latch preventing opening of said door during operation of said motor and rotation of said rolls, each of said rolls including spaced rows of piercing pins on an outer surface thereof.

2. A carton piercing and crushing device as set forth in claim 1 which includes at least one spring, one end of said spring connected to said door, said spring automatically closing said door subsequent to being opened to insert a carton for disposal, the other end of said spring connected to said housing.

3. A carton piercing and crushing device as set forth in claim 2 which includes a spring on opposite sides of said door which closes said door subsequent to being opened.

4. A carton piercing and crushing device as set forth in claim 3 in which said switch is a magnetic proximity switch, said switch having one portion on said door and one portion on said upper end wall.

5. A carton piercing and crushing device as set forth in claim 4 which includes a first timed electrical circuit for operation of said electronic door latch, and a second timed electrical circuit for operation of said motor, said first and second timed circuits being controlled by said switch when said door closes subsequent to being opened.

6. A carton piercing and crushing device as set forth in claim 2 in which said switch is a magnetic proximity switch, said switch having one portion on said door and one portion on said upper end wall.

7. A carton piercing and crushing device as set forth in claim 6 which includes a first timed electrical circuit for operation of said electronic door latch, and a second timed electrical circuit for operation of said motor, said first and second timed circuits being controlled by said switch when said door closes subsequent to being opened.

8. A carton piercing and crushing device as set forth in claim 1 in which said switch is a magnetic proximity switch, said switch having one portion on said door and one portion on said upper end wall.

9. A carton piercing and crushing device as set forth in claim 8 which includes a first timed electrical circuit for operation of said electronic door latch, and a second timed electrical circuit for operation of said motor, said first and second timed circuits being controlled by said switch when said door closes subsequent to being opened.

10. A carton piercing and crushing device as set forth in claim 1 which includes, a first timed electrical circuit for operation of said electronic door latch, and a second timed electrical circuit for operation of said motor, said first and second timed circuits being controlled by said switch when said door closes subsequent to being opened.

11. A carton piercing and crushing device as set forth in claim 1 which includes a first receptacle for receiving said pierced and crushed cartons, said first receptacle located beneath said pair of rolls.

12. A carton piercing and crushing device as set forth in claim 11 which includes a second receptacle for receiving waste liquid contained in said pierced and crushed carton, and said first receptacle including holes in a bottom surface through which waste fluid flows into said second receptacle, said second receptacle located beneath said first receptacle.

13. A carton piercing and crushing device as set forth in claim 1 which includes a crushed carton stripper plate secured adjacent to a bottom surface of each of said rolls which strips said pierced and crushed cartons from said rolls.

14. A carton piercing and crushing device as set forth in claim 13 in which said outer surface of said rolls is formed of a rubber substance.

15. A carton piercing and crushing device as set forth in claim 13 in which said device includes a chute between said door and said rolls which guides said cartons from said door to said rolls.

16. A carton piercing and crushing device as set forth in claim 1 in which said outer surface of said rolls is formed of a plastic substance.

17. A carton piercing and crushing device as set forth in claim 16 in which said device includes a chute between said door and said rolls which guides said cartons from said door to said rolls.

18. A carton piercing and crushing device as set forth in claim 1 in which said device includes a chute between said door and said rolls which guides said cartons from said door to said rolls.

* * * * *